US012428926B2

(12) United States Patent
Kennedy

(10) Patent No.: US 12,428,926 B2
(45) Date of Patent: Sep. 30, 2025

(54) DISSOLVABLE CONVERTIBLE PLUG

(71) Applicant: Shale Oil Tools, LLC, Rosenberg, TX (US)

(72) Inventor: Brian Kennedy, Sugar Land, TX (US)

(73) Assignee: Shale Oil Tools, LLC, Rosenberg, TX (US)

( * ) Notice: Subject to any disclaimer, the term of this patent is extended or adjusted under 35 U.S.C. 154(b) by 0 days.

(21) Appl. No.: 17/657,549

(22) Filed: Mar. 31, 2022

(65) Prior Publication Data

US 2023/0313633 A1 Oct. 5, 2023

(51) Int. Cl.
*E21B 33/12* (2006.01)
*E21B 34/08* (2006.01)

(52) U.S. Cl.
CPC ..... *E21B 33/1208* (2013.01); *E21B 34/08* (2013.01); *E21B 2200/05* (2020.05); *E21B 2200/08* (2020.05)

(58) Field of Classification Search
CPC ... E21B 33/1208; E21B 2200/08; E21B 34/08
See application file for complete search history.

(56) References Cited

U.S. PATENT DOCUMENTS 3,398,795 A * 8/1968 Elliston ..... E21B 33/128 166/134
4,237,980 A * 12/1980 Robinson ..... E21B 34/063 166/324
10,619,448 B1 * 4/2020 Watson ..... E21B 34/063
2007/0215356 A1 * 9/2007 Leeb ..... E21B 21/10 166/325

(Continued)

OTHER PUBLICATIONS

Schlumberger Oilfield Glossary—Mandrel—https://glossary.slb.com/en/terms/m/mandrel (Year: 2023).*

*Primary Examiner* — David Carroll
(74) *Attorney, Agent, or Firm* — Ramey LLP

(57) ABSTRACT

In wellbore completions it is sometimes desirable to block fluid flow from lower in the well towards an upper portion of the well. In a current embodiment of the invention a plug may be placed within a wellbore and, once set, the plug prevents fluid flow past the plug. The plug includes a throughbore into which an object may be placed. The object may be solid and incorporate a shear device such as a shear pin so that in the presence of pressure from above the plug the object may be removed from the throughbore to allow fluid flow through the throughbore of the plug. In the alternative, pressure provided by fluid below the plug is not able to remove the object from the throughbore of the plug. In other embodiments the object within the throughbore of the plug may include a flapper valve to prevent fluid flow from below while allowing fluid flow from above. The flapper valve may also include a shear pin so that a certain amount of pressure is required to open the flapper valve to pressure from above. In order to avoid drilling out the plug in the event that the object within the throughbore cannot be removed or the operator simply desires full wellbore casing access, the plug as well as most components of the plug are constructed of a dissolvable metal such as dissolvable aluminum or dissolvable magnesium.

3 Claims, 5 Drawing Sheets

(56) References Cited

U.S. PATENT DOCUMENTS

| | | | | |
|---|---|---|---|---|
| 2013/0240203 | A1* | 9/2013 | Frazier | E21B 33/134 166/192 |
| 2013/0319682 | A1* | 12/2013 | Tschetter | E21B 33/1208 166/376 |
| 2015/0285026 | A1* | 10/2015 | Frazier | E21B 33/128 166/120 |
| 2016/0123106 | A1* | 5/2016 | Sechere | E21B 33/128 166/191 |
| 2019/0352998 | A1* | 11/2019 | Wolf | E21B 33/12 |
| 2022/0397013 | A1* | 12/2022 | Arabie | E21B 33/128 |
| 2023/0184052 | A1* | 6/2023 | Newberry | E21B 33/1208 166/386 |
| 2023/0272685 | A1* | 8/2023 | Dave | E21B 23/06 |

* cited by examiner

DISSOLVABLE CONVERTIBLE PLUG

BACKGROUND

In certain instances when drilling an oil or gas well, portions of the wellbore may need to be divided one from another. A common instance of dividing the wellbore is using a plug that is inserted in the wellbore so that fluid from lower in the wellbore is prevented from flowing into the upper portion of the wellbore.

Usually the partition is temporary requiring the operator to trip into the well to retrieve it or with a drill or mill in order to remove the plug. During the completion stage of the well it is not economically feasible to mobilize a rig or coil tubing rig to drill or mill the partition.

The need for this partition is to control the well's bottom hole pressure while the production tubing can be installed and the production tree be installed at surface.

It is desirable that this partition be placed as deep as possible so that the end of the production tubing can be installed as deep as possible into the curve of the well where it transitions from a vertical wellbore to a horizontal wellbore. In a horizontal well the depth of installing the partition is limited because it is difficult to retrieve traditional packers and plugs when the well begins to deviate greater than 15 to 20 degrees from vertical.

SUMMARY

In an embodiment of the current invention, a plug is constructed having a throughbore, an external sealing element, and a set of slips. While the plug may simply include a throughbore with an orifice to slow or regulate fluid as it moves from below the plug to above the plug in many instances the plug will include an object within the throughbore to prevent fluid flow from below the plug from moving to above the plug. The object may include a one-way check valve, such as a flapper valve, to allow fluid flow from above the plug to below the plug while preventing fluid flow from below the plug to above the plug. The object may be pinned or otherwise held in place such that with a sufficient amount of pressure from above the object is removed from the throughbore to allow fluid flow through the throughbore, regulated or otherwise. The object may also be frustroconical, preferably with a cooperating frustroconical throughbore such that pressure from below the plug forces the object into a tighter seal within the throughbore while sufficient fluid pressure from above the plug may remove the object from the throughbore.

In an additional embodiment of the current invention the body of the plug and/or the object in the throughbore are made of a dissolvable material, including dissolvable metal alloys in particular a dissolvable magnesium alloy or dissolvable aluminum alloy. Generally, the dissolvable material begins to dissolve upon being placed within a wellbore fluid. In many instances the rate of dissolution of the material is increased in warmer fluid. Additionally, the dissolvable material may be dissolved at a faster rate in the presence of certain fluids including salts and acids such as hydrochloric or sulfuric acid. By allowing the plug to dissolve in the presence of certain fluids the operator may avoid having to retrieve the plug or bring back a work over or other rig in order to drill out the plug.

DETAILED DESCRIPTION

The description that follows includes exemplary apparatus, methods, techniques, or instruction sequences that embody techniques of the inventive subject matter. However, it is understood that the described embodiments may be practiced without these specific details.

Figure 1:
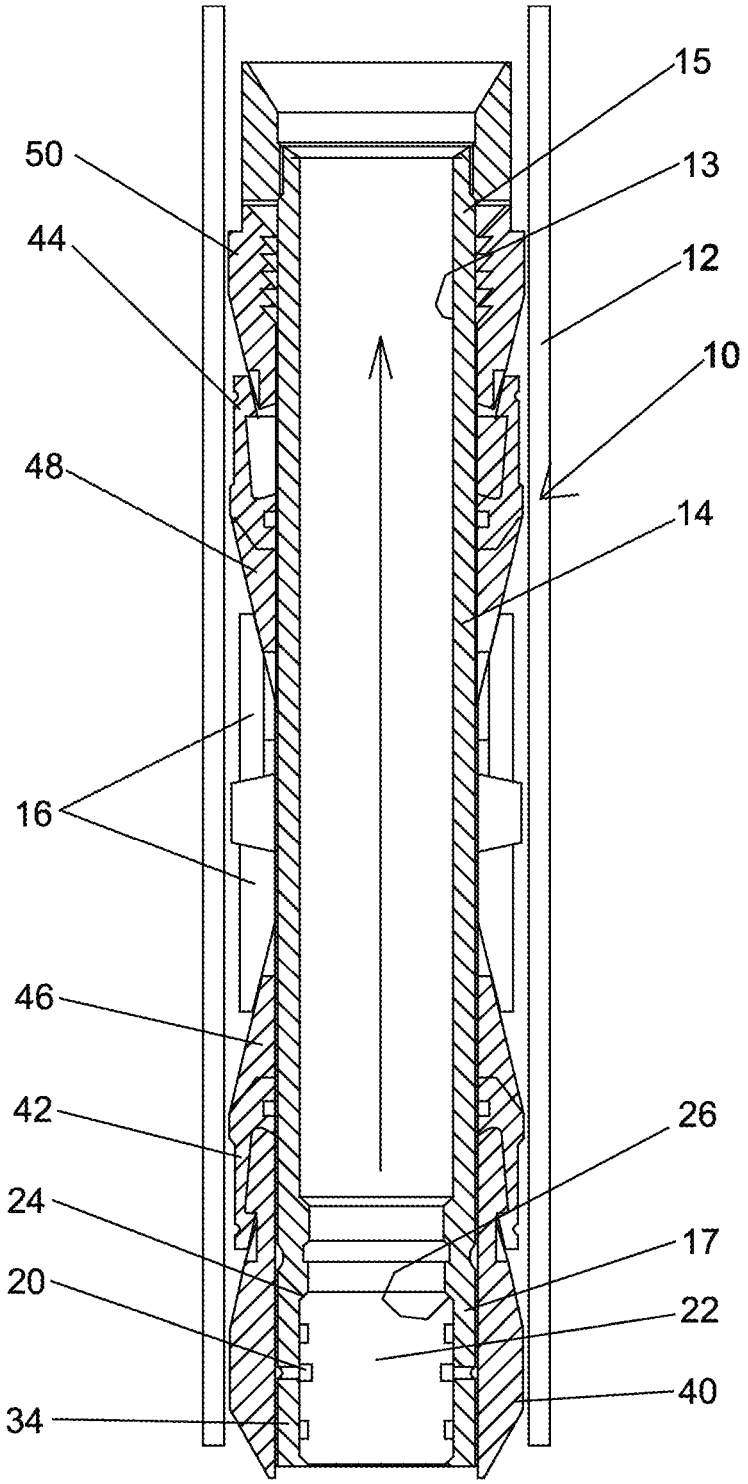
FIG. 1 is a cross-section of a plug within the casing in the plug's run-in configuration.

FIG. 1 is a cross-section of a plug 10 within the casing 12 in the plug's 10 run-in the configuration. The plug 10 includes a mandrel 14, a set of slips 16, an upper sealing element 44, a lower sealing element 42, and a throughbore 18. A subsection 20 of the throughbore 18 is configured such that an object 22 may be inserted subsection 20. In the run-in configuration the various elements of the plug 10 are stretched out along the length of the mandrel 14 such that the overall outer diameter of the plug 10 is less than the internal diameter of the casing 12. In this embodiment, subsection 20 throughbore 18, is configured such that there is a shoulder 24 and an upper end of subsection 20 and object 22 is configured to have a shoulder 26 such that when object 22 is within subsection 20 of throughbore 18 the object 26 shoulder will cooperate with subsection 20 shoulder 24 to retain object 22 in place within the throughbore with any pressure from below as indicated by arrow 30 is present. In addition, mandrel 14 includes a port 32 into which a pin 34 may be inserted through port 32 into recess or pocket 36 with an object 22. Pin 34 will maintain object 22 in place within subsection 20 of throughbore 18 until sufficient pressure is present from above to shear pin 34 thereby releasing object 22 from within subsection 20.

Figure 2:
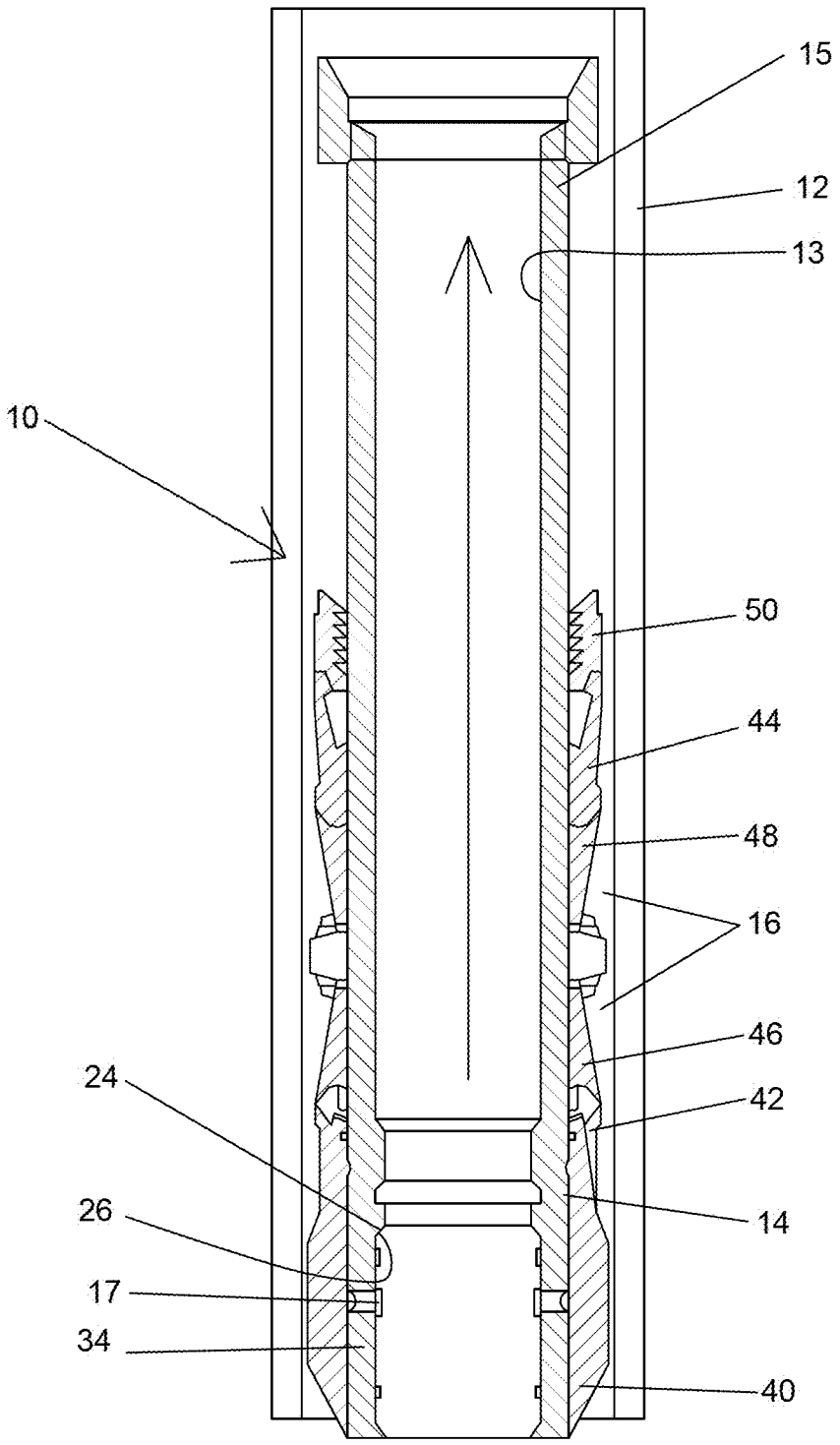
FIG. 2 is a side view of the plug within the casing in the plug's set position.

FIG. 2 is a side view of the plug 10 within the casing 12 in the plug's 10 set position. In the set position the nose 40 of the plug 10 is held in position with respect to the mandrel 14. Typically, a generally available setting tool is utilized to apply a force to longitudinally compress or move the various components mounted on the exterior of the mandrel 14 such as a lower sealing element 42, an upper sealing element 44, a lower wedge 46, an upper wedge 48, and a locking ring 50 are forced to move from the upper end 15 of the mandrel 14 towards the lower end 17 of the mandrel 14. As the externally mounted components move towards the lower end 17 of the mandrel 14 upper wedge 48 and lower wedge 46 are forced under upper sealing element 44 and lower sealing element 42 forcing upper sealing element 44 and lower sealing element 42 to move radially outward into contact with the inner diameter 13 of casing 12. Generally, with the slips 16 in contact with the inner diameter 13 of the casing 12 the plug 10 is held in place within the casing 12.

In the set position the object 22 is held within subsection 20 by shear pin 34. Shear pin 34 provides resistance to moving the plug downward and out of subsection 22 that may result from any pressure acting on the object 22 from above. If sufficient pressure is provided from above then shear pin 34 may release allowing fluid to flow through the throughbore 18 past plug 10. Resistance to moving object 22 in an upward direction is provided in a current embodiment by subsection 20's shoulder 24 which cooperates with object 22's shoulder 26 so that any pressure acting against object 22 from below creates a force acting through object 22 such that object 22's shoulder 26 is forced into subsection 20's shoulder 24. Due to the shoulders 24 and 26 cooperating to prevent the object 22 from moving upward the plug 10 or at least a portion of the plug 10 would fail before object 22 is able to move in an upward direction. As shown in FIG. 2 the cooperating shoulders 24 and 26 are set at some angle, in this instance about 45°, with the longitudinal axis of plug 10. It is anticipated that the angle of the cooperating shoulders 24 and 26 with the longitudinal axis of plug 10 may be anywhere from 10° to 135°.

Figure 3:
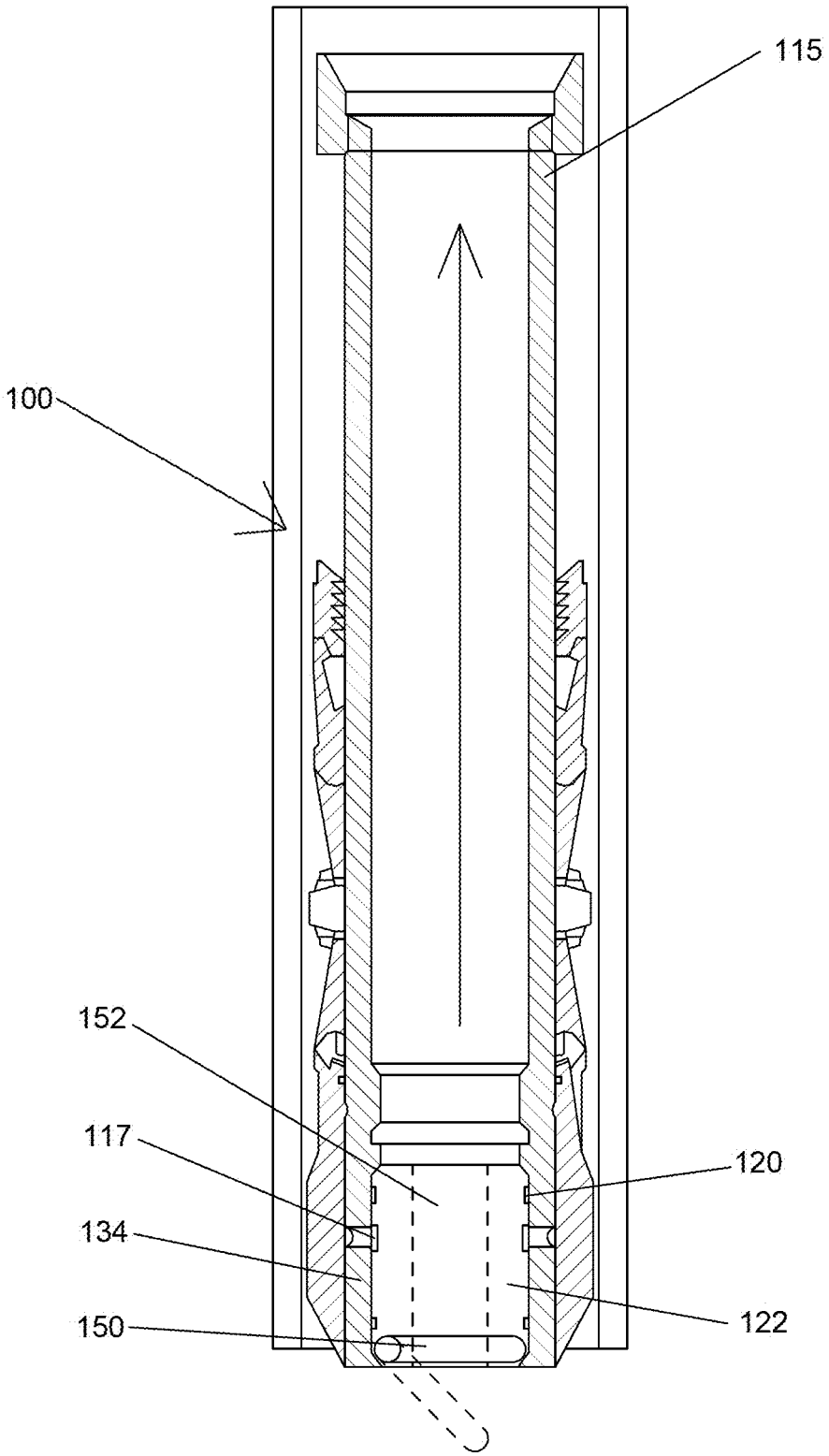
FIG. 3 depicts a side view of an alternative embodiment a plug where the object may incorporate a flapper valve.

FIG. 3 depicts an alternative embodiment a plug 100 where the object 122 may incorporate a flapper valve 150. In this case the object 122 also includes a throughbore 152. At the lower end 117 of the throughbore 152 is a flapper valve 150. The flapper valve 150 in its closed position prevents fluid flow past the flapper towards the upper end 115 of plug 100. In the event that the operator wishes to provide fluid flow from the upper end 115 of flapper valve 150 the operator must provide fluid pressurized to a sufficient amount to open flapper valve 150. In some instances, the flapper valve 150 may be pinned closed with a shear pin 152 or other shear device. In the event that the operator wishes for an increased downward flow above the downward flow available through the throughbore 151 of object 122 flow may be increased to a point where pressure builds up on the upper end of object 122. If sufficient pressure is provided shear pins 134 may shear allowing object 122 to be removed from the subsection 120.

Figure 4:
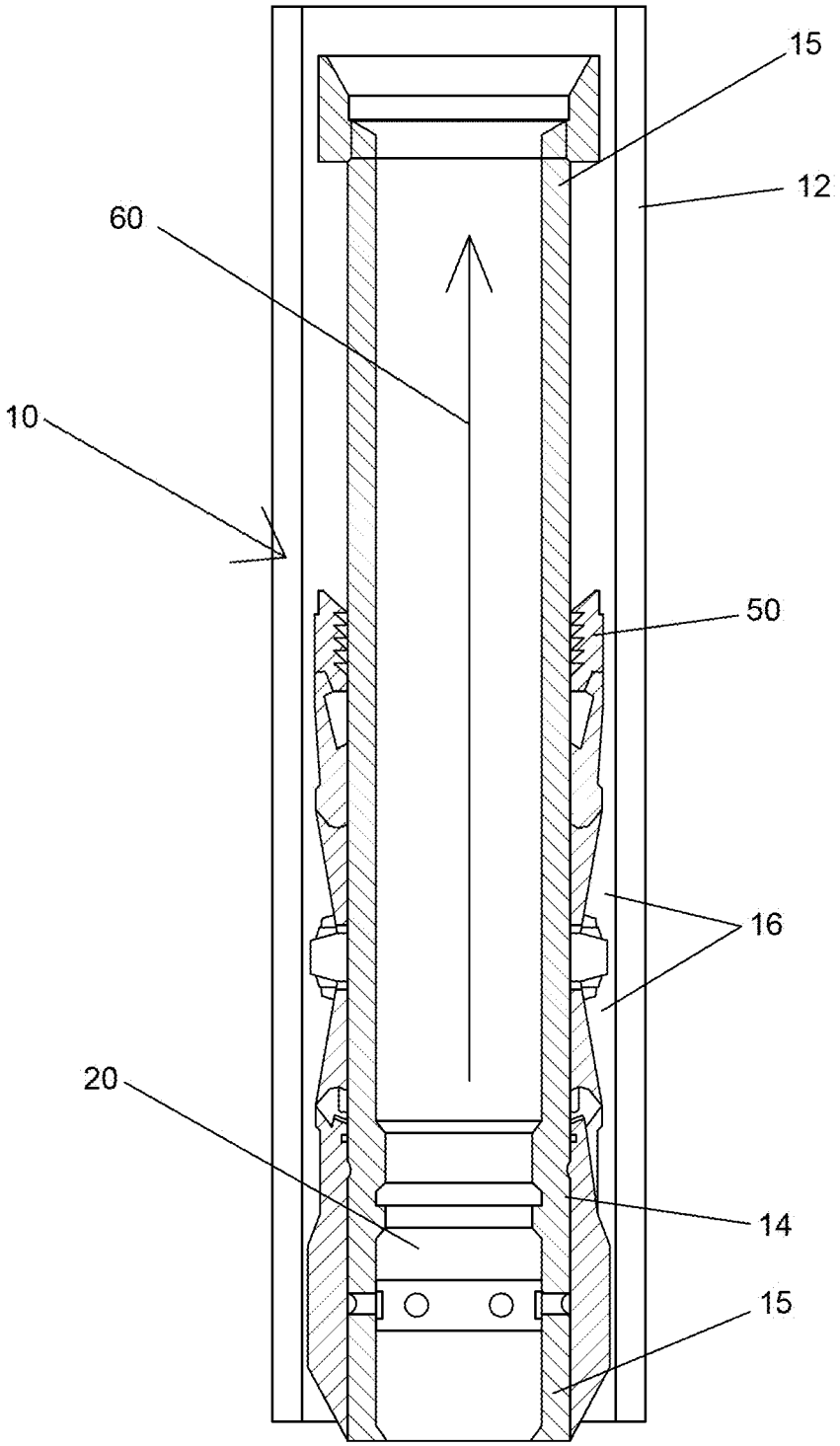
FIG. 4 depicts a side view of the plug with the sealing element in contact with the casing and after an object has been removed from a subsection of the throughbore.

FIG. 4 depicts the plug 10 after object 22 has been removed from subsection 20 the upper sealing element 44 and the lower sealing element 42 are in contact with casing 12 due to the locking ring 50 maintaining the radial compression of the various components of the plug 10 with respect to mandrel 14. With object 22 removed fluid may flow from the lower end 15 of plug 10 towards the upper end 17 of plug 10 as indicated by arrow 60.

Figure 5:
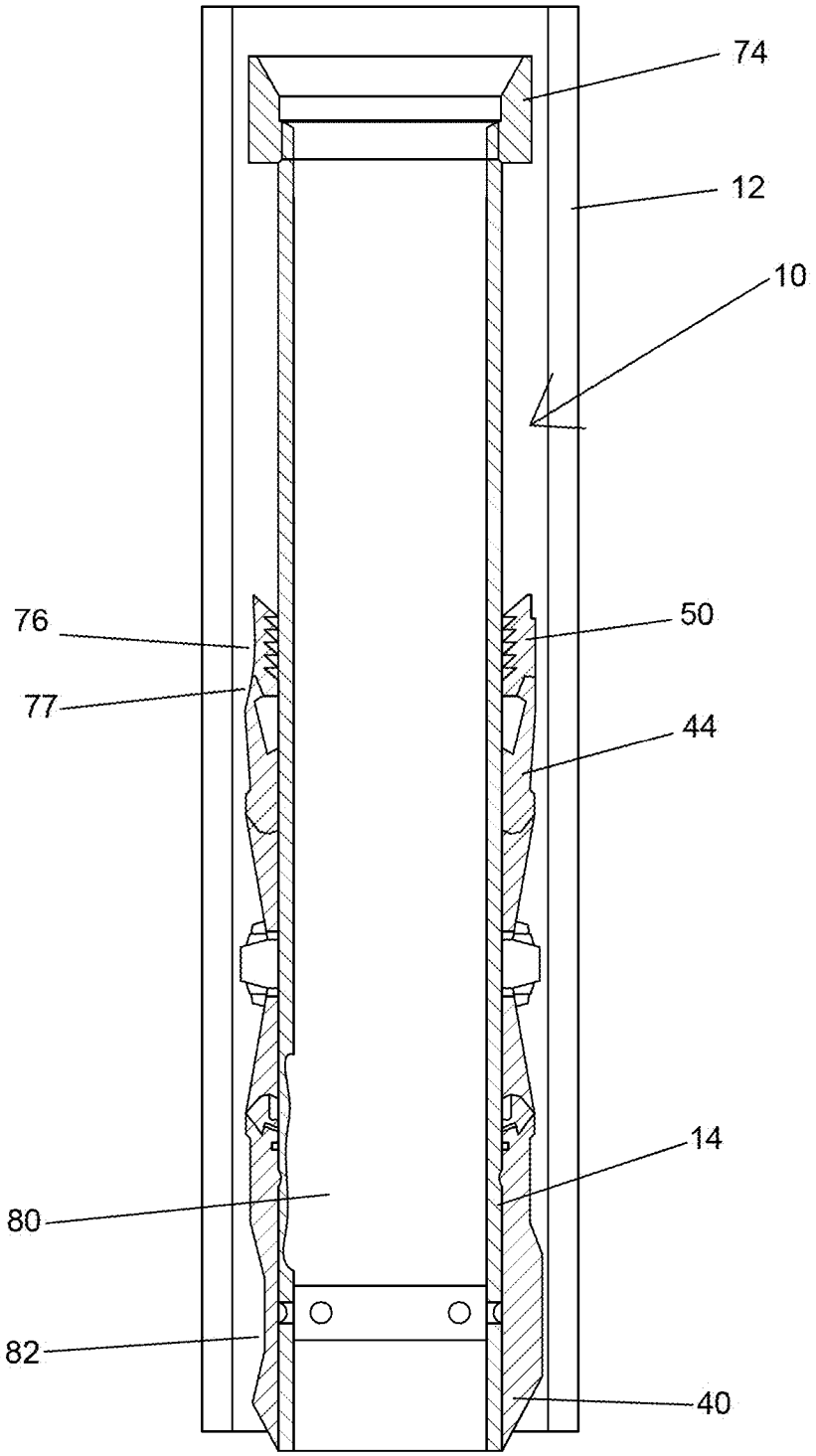
FIG. 5 depicts a plug within the casing after having spent some time in the presence the presence of a fluid capable of dissolving the plug such that portions of the plug have begun to dissolve.

FIG. 5 depicts a plug 10 within casing 12. The plug 10 has, as shown, been in the presence of a fluid capable of dissolving the plug 10. As indicated portions of the plug such as portion 74 at the upper end of the plug is shown to have been dissolved away. Additionally portion 76 of locking ring 50 is shown to have been dissolved away as well as portion 77 of upper anti-extrusion ring 44 moving further downward on the plug we can see that a portion 80 of the mandrel 14 and a portion 82 of lower end 40 have also been dissolved away. Provided sufficient time most components of the plug 10 will simply dissolve away providing an open casing 12.

While the embodiments are described with reference to various implementations and exploitations, it will be understood that these embodiments are illustrative and that the scope of the inventive subject matter is not limited to them. Many variations, modifications, additions and improvements are possible.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A downhole device comprising:

a mandrel having a throughbore, a radially extendable sealing element on the exterior of the mandrel, and an object within the throughbore;

wherein the object includes an object throughbore;

wherein, the object is prevented from moving upward within the throughbore by a throughbore shoulder cooperating with an object shoulder wherein the object within the throughbore is removable from the throughbore by pressure above the object;

wherein the object within the throughbore seals the throughbore preventing fluid flow from below the object;

further wherein the object within the throughbore is not removable from the throughbore by pressure below the object;

the mandrel and the object are constructed of dissolvable material.

2. A method of temporarily plugging a well, comprising:

locating a dissolvable plug within a wellbore, wherein the plug has a mandrel having a throughbore, a radially extendable sealing element on the exterior of the mandrel, and an object within the throughbore;

wherein the object is prevented from moving upward within the throughbore by a throughbore shoulder cooperating with an object shoulder;

wherein the object within the throughbore is removable from the throughbore by pressure above the object further wherein, the mandrel and the object are constructed of dissolvable material, pressuring the wellbore below the plug, wherein the object within the throughbore is not removable from the throughbore by pressure below the object, wherein the object within the throughbore seals the throughbore preventing fluid flow from below the object;

removing the plug from the wellbore.

3. A method of temporarily plugging a well, comprising:

locating a dissolvable plug within a wellbore, wherein the plug has a mandrel having a throughbore, a radially extendable sealing element on the exterior of the mandrel, and an object within the throughbore; wherein the object includes a throughbore;

wherein the object within the throughbore is removable from the throughbore by pressure above the object further wherein, the mandrel and the object are constructed of dissolvable material, pressuring the wellbore below the plug, wherein the object within the throughbore is not removable from the throughbore by pressure below the object, wherein the object within the throughbore seals the throughbore preventing fluid flow from below the object;

removing the plug from the wellbore.

* * * * *